US006996945B2

(12) United States Patent
Doty

(10) Patent No.: US 6,996,945 B2
(45) Date of Patent: Feb. 14, 2006

(54) SELF INTERLOCKING BLOCK SYSTEM

(76) Inventor: Steven E. Doty, 18 Brittany Woods Rd., Charleston, WV (US) 25314

( * ) Notice: Subject to any disclaimer, the term of this patent is extended or adjusted under 35 U.S.C. 154(b) by 0 days.

(21) Appl. No.: 10/439,928

(22) Filed: May 16, 2003

(65) Prior Publication Data

US 2004/0226246 A1 Nov. 18, 2004

(51) Int. Cl.
*E04C 1/00* (2006.01)
*E04B 2/24* (2006.01)

(52) U.S. Cl. ..... 52/585.1; 52/582.1; 52/606; 52/747.12

(58) Field of Classification Search ..... 52/606, 52/592.5, 592.1, 585.1, 582.1, 747.12
See application file for complete search history.

(56) References Cited

U.S. PATENT DOCUMENTS

| | | | | | |
|---|---|---|---|---|---|
| 2,552,712 | A | * | 5/1951 | Hite | 52/274 |
| 2,826,906 | A | * | 3/1958 | Rice | 52/585.1 |
| 3,005,282 | A | | 10/1961 | Christiansen | |
| 3,479,782 | A | * | 11/1969 | Muse | 52/438 |
| 3,780,484 | A | * | 12/1973 | Muse | 52/585.1 |
| 4,110,949 | A | * | 9/1978 | Cambiuzzi et al. | 52/437 |
| 4,115,980 | A | * | 9/1978 | Martel et al. | 52/590.2 |
| 4,249,354 | A | * | 2/1981 | Wynn | 52/438 |
| 4,426,815 | A | | 1/1984 | Brown | |
| 5,226,275 | A | | 7/1993 | Trahan | |
| 5,241,795 | A | * | 9/1993 | Giroux et al. | 52/503 |
| 5,527,201 | A | | 6/1996 | Maddock | |
| 5,575,128 | A | | 11/1996 | Haener | |
| 5,588,271 | A | | 12/1996 | Pitchford | |
| 5,653,621 | A | | 8/1997 | Yao | |
| 5,685,119 | A | * | 11/1997 | Zschoppe | 52/592.5 |
| 5,711,130 | A | | 1/1998 | Shatley | |
| 5,715,635 | A | | 2/1998 | Sherwood | |
| 5,802,792 | A | * | 9/1998 | Fielding et al. | 52/396.09 |
| 5,901,520 | A | | 5/1999 | Abdul-Baki | |
| 5,966,889 | A | | 10/1999 | Zinner | |
| 5,987,840 | A | * | 11/1999 | Leppert | 52/592.6 |
| 6,050,044 | A | | 4/2000 | McIntosh | |
| D429,346 | S | | 8/2000 | Martin, Jr. | |
| 6,185,888 | B1 | * | 2/2001 | Wasson | 52/300 |
| 6,298,632 | B1 | | 10/2001 | Sherwood | |
| 6,447,213 | B1 | | 9/2002 | MacDonald | |

(Continued)

FOREIGN PATENT DOCUMENTS

CH 611372 A5 * 5/1979

OTHER PUBLICATIONS

"Country Manor Design and Construction Manual," Keystone Retaining Wall Systems, Feb. 2002.

(Continued)

*Primary Examiner*—Naoko Slack
*Assistant Examiner*—Joseph Edell
(74) *Attorney, Agent, or Firm*—Steptoe & Johnson PLLC

(57) ABSTRACT

A self interlocking block system wherein blocks with one or more apertures are interconnected by inserting a hollow peg through the aligned apertures of two vertically adjacent blocks such that a portion of the hollow peg extends into the aperture of the top block and a portion of the hollow peg extends into the aperture of the bottom block, resulting in a vertical shaft extending from the top row of blocks through the bottom row of blocks to the base surface. The vertical shafts may be filled with one or more vertical support bars and/or filler material to provide additional support.

22 Claims, 6 Drawing Sheets

U.S. PATENT DOCUMENTS

| | | | | |
|---|---|---|---|---|
| 6,464,432 | B1 | 10/2002 | Shaw | |
| 6,571,525 | B1 * | 6/2003 | Coleman | 52/592.5 |
| 2002/0028114 | A1 | 3/2002 | Whitson | |

OTHER PUBLICATIONS

Advertising brochure—"Production Essentials for the Groutless & Mortarless Flex Lock Wall System," Cercorp Initiatives, Inc.

Advertising brochure—"Retaining Wall Guide," Versa-Lok Retaining Wall Systems Solid Solutions, Quality Block & Supply, Inc., 2002 Kiltie Corporation.

Technical Bulletin 5—"Versa-Lok Retaining Wall Systems—Technical Bulletin 5," Quality Block & Supply, Inc., 1999 Kiltie Corporation.

Advertisement—"Design Pro," The Concrete Producer—Mar. 2002.

* cited by examiner

FIG. 1B
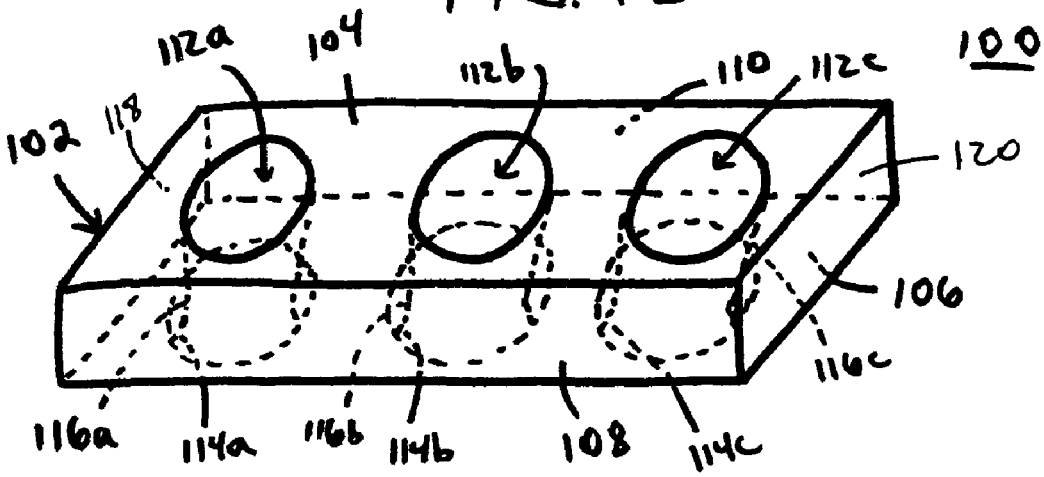
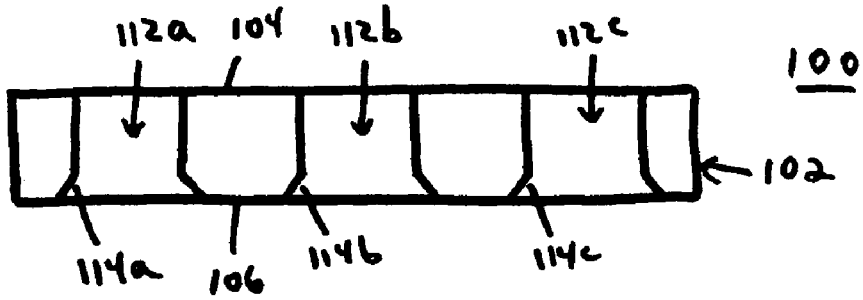
FIG. 1A

SELF INTERLOCKING BLOCK SYSTEM

BACKGROUND OF INVENTION

1. Field of the Invention

This invention relates to retaining wall blocks, and more particularly, to a self interlocking, mortarless block system having vertically adjacent blocks interconnected with hollow pegs.

2. Related Art

Masonry construction has been used to construct above and below walls, retaining walls, and foundations for centuries. Conventional masonry systems is the assembly of building blocks by laying blocks adjacent to each other with some type of mortar placed in-between two such adjacent blocks. Upon setting or hardening, the mortar acts as an adhesive and holds the blocks together.

One of the principal disadvantages with wanting to build a conventional above or below grade wall, retaining wall or foundation wall is the need for a skilled mason. The typical homeowner, property owner, or contractor cannot easily build such a wall because of the many issues involved, e.g., the needed consistency of the mortar, the aligning of adjacent blocks, the amount and level of mortar between the blocks, the cost of a skilled mason, and most of all, the availability of a skilled mason. Therefore, there is a need for a self interlocking block system that is mortarless, wherein an unskilled laborer can easily and quickly, in all types of weather, build an above or below grade wall, retaining wall, or foundation wall.

Another disadvantage with building a conventional wall is that this activity is weather dependent. When using mortar, a laborer can only build a wall under the appropriate weather conditions. That is, it is impossible to build a wall using mortar if the weather is below freezing, or, it is too wet. Therefore, there is a need for a self interlocking block system that is mortarless such that building a wall is not dependent on the weather conditions.

Another disadvantage with building a conventional wall is that the activity is very labor intensive. It takes a lot of labor to lay each block in the wall, by making sure that each block has the appropriate amount of mortar around the edges, is level, and is square and "plumb" with the rest of the masonry units in the wall.

Another disadvantage with building a conventional wall is that the activity is very time consuming. It takes a lot of time to mix the ingredients comprising the mortar, transporting the mortar to the skilled mason, and precisely placing the mortar between each adjacent masonry block, leveling and "plumbing" the whole wall, "tooling" the masonry joints, and finally cleaning the spilled masonry cement from the wall surfaces and around the construction site.

Another disadvantage with building a conventional wall is that the activity is very expensive. The cost of the mortar, mixing the mortar, transporting the mortar to the wall, placing the mortar in the adjacent masonry blocks, leveling and plumbing all blocks, tooling the masonry joints, cleaning the mortar off the wall when finished, and cleaning up the "mortar mess" when the job is complete.

Another disadvantage with building a conventional wall is the minimal amount of lateral structural load capacity of the finished wall. When a force, such as the soil around the outside of a masonry foundation wall, exerts lateral loads against the exterior of the wall, the conventional masonry wall (i.e., its hollow cores are not filled with grout and supplemented with vertical steel reinforcing re-bar or steel horizontal reinforcing mesh is not periodically and structurally imbedded into the horizontal mortar joints between the masonry blocks) is subject to failure by being "pushed in" by the lateral load of the unstable foundation fill material. Therefore, there is a need for a self interlocking, mortarless block system that produces a finished wall capable of withstanding increased lateral load forces.

There are several types of mortarless block systems that are available; however, each one fails to satisfy the current need for a self locking, mortarless masonry block system. Specifically, almost all the prior art provide virtually no lateral load capability without the need for grout and vertical reinforcement, e.g., steel re-bar, embedded within the grout.

In U.S. Pat. Nos. 6,298,632 and 5,715,635 to Sherwood for a modular building block unit, a building block is disclosed having multiple, circular apertures extending through the height of the blocks. The apertures, however, provide no specific purpose or function in the use of these blocks in building a wall. The patent merely states that a block of that invention may be formed with holes extending through the thickness of the block as a means for reducing the weight of the block, such as in conventional blocks. The focus of these patents is to vertically interlock two adjacent blocks via mounting strips attached to the blocks. Furthermore, there is no teaching or suggestion that the holes of two vertically adjacent blocks must be aligned. A top block may slide horizontally on top of a bottom block along the mounting blocks such that the holes of the blocks either align or do not align. Lastly, a problem with this type of mortarless block is that the block cannot be manufactured in a single step process. That is, the block cannot be manufactured with a conventional block machine wherein the mounting strips are an integral part of the block itself. The mounting strips must be secured to the block after the block is made. Therefore, there is a need for a self interlocking, mortarless block system wherein the blocks of the system are manufactured in a single step without the need to secure other components to the block.

In U.S. Pat. No. 6,050,044 to McIntosh, a block is disclosed that is very similar to a conventional "LEGO" toy block wherein it has multiple, closed posts extending up from the top face of the block which interlock into the bottom of a vertically adjacent block. In addition, this block has side-by-side connectors that permit the connecting of blocks horizontally for the construction of weight bearing spanning structures. Due to the difficulties in making a masonry block with such posts extending from the surface of the block, this block is intended to be made of plastic by injection molding. Therefore, there is a need for a masonry, self interlocking block that is easily manufactured with a conventional block machine.

In U.S. Pat. No. 5,966,889 to Zinner, a block is disclosed wherein a "tongue" of one block fits within a "groove" of a vertically adjacent block. The purpose of this block is to eliminate the need for reinforced concrete with reinforcement rods positioned in vertical lines of block holes of a conventional block. Furthermore, the '889 block system requires an adhesive material to join two adjacent blocks wherein a dry powder is placed between two blocks as they are laid. The wall is later wet, thereby causing the powder to bond the blocks together. As above, this patent also recognizes the problems with conventional block building using mortar due to the settling of the blocks and the requirement of skilled labor. Therefore, there is a need for a self interlocking block system that does not require the use of an adhesive material nor mortar to hold two adjacent blocks together, and that can be used quickly and efficiently by an unskilled laborer.

In U.S. Pat. No. 5,711,130 to Shatley, a building block system is disclosed that uses pins to join two vertically adjacent blocks. Because the pins are solid and not hollow, there is no means for further supporting assembled blocks with a filler material. Also, the pins are not intended to contact vertically other pins, such that the pins are "fatter" on the top side to prevent the pins from falling through the holes to the block below. Therefore, a wall of these building blocks does not provide a vertical shaft from the top of the wall to the bottom of the wall in which additional support materials can be placed. Also, this block system provides virtually no lateral load capabilities. Therefore, there is a need for a self interlocking block system having a means for vertically supporting a wall.

In U.S. Pat. No. 3,005,282 to Christiansen, a toy building block is disclosed that is similar in design to the block of the '044 patent to McIntosh. As such, this toy block is impossible to manufacture out of a masonry material on a conventional block machine due to the protrusions on the top surface of the block. Therefore, there is a need for a self interlocking, masonry block that can be manufactured using a conventional block machine.

In addition to the above, patented block systems, there are other commercially available block systems that attempt to solve the problems in the art. For example, Azar Mortarless Building Systems, Inc. offers an Azar Block mortarless system that only requires a grout fill. The disadvantage with the Azar Block is that there is no means for vertically aligning two adjacent blocks, and no means for providing a vertical shaft through a wall of Azar Blocks for additional support. In addition, the laborer must still add a grout fill.

Cercorp Initiatives, Inc. provides a FlexLock block that interlock using ground-mating surfaces and post-tension tendons. That is, the FlexLock block system requires both masonry and hardware components. Protrusions on the top face of a first block fit within recesses in the bottom face of a vertically adjacent block. The disadvantages with the FlexLock block system is that it also does not provide a vertical shaft extending from the top of a wall to the bottom of the wall that can be used for additional support, that it is difficult to use a conventional block machine to manufacture blocks with such protrusions on the top surface, and that it is difficult to manufacture recesses and protrusions on masonry blocks that actually interlock. Also, this block system provides virtually no lateral load capabilities.

Versa-Lok Retaining Wall Systems, a division of Kiltie Corporation, provides a Versa-Lok system similar to the '130 patent wherein vertically adjacent blocks are interlocked with pins. Thus, the same disadvantages with the '130 patent are present in the Versa-Lok system. Also, this block system provides virtually no lateral load capabilities.

In addition to the above noted disadvantages, none of these prior art block systems are portable or reusable. That is, these systems cannot be pre-manufactured, or pre-assembled, and then transported to a final destination. Also, once a wall is built using any of these masonry, block systems, the wall cannot be disassembled without destroying the wall such that the component parts of the wall cannot be reused in constructing a new wall. Therefore, there is a need for a self interlocking block system with which a wall can be pre-assembled, easily transported to a final destination, and secured at that destination. There is still a further need for a self interlocking block system that provides for a wall to be easily disassembled and its component parts reused in the construction of another wall.

Therefore, despite the many attempts, there is still a need for a mortarless, interlocking block system that can be easily and quickly used to build an above or below grade wall, a retaining wall, or a foundation wall.

SUMMARY OF INVENTION

The self interlocking block system of the present invention solves the problems with conventional interlocking, mortarless systems by providing a masonry block having a top surface, a bottom surface, a front surface, a back surface, end surfaces, and one or more apertures extending from the top surface through the block to the bottom surface, and hollow pegs for interlocking two vertically adjacent blocks. When building a wall using the present system, a laborer merely places a block on top of one or more other blocks such that one or more apertures of the top block align with apertures of the bottom blocks. A hollow peg, having the shape of an aperture and an outer diameter about equal to the diameter of the apertures in the block, is inserted into each aperture such that a portion of the peg extends into the aperture of the top block and into the aperture of the bottom block, thereby spanning the two vertical blocks. The wall is further built in the same manner using blocks and hollow pegs such that one or more vertical shafts extend from the top row of blocks through the bottom row of blocks to the base surface on which the wall is built. Then, optionally, one or more support bars are inserted in the vertical shafts and/or filler material is poured into the vertical shafts to provide additional stability and durability to the wall. The apertures of the blocks also may have a guiding portion on the bottom surface of the block that facilitates the placement of a top block onto a hollow peg in an aperture of a bottom block.

There are numerous advantages with the self interlocking block system of the present invention. The blocks and hollow pegs can be installed very quickly by unskilled laborers, such that the block system is a "Do-It-Yourself" style of block system. Therefore, the need and expense for a skilled mason is eliminated because there is no need for mortar. A wall using the present block system can be built in almost all weather conditions, even at levels far below freezing.

In addition, because the only requirement for the blocks of the present invention is that the blocks have one or more apertures extending through the blocks, the blocks can be manufactured using a conventional, high-speed masonry block machine. Therefore, the blocks are dimensionally accurate building blocks, resulting in the blocks being self aligning, self-plumbing, self-leveling, and available at any length, width, and height, and with any number, size, and shape of apertures. Furthermore, as with conventional blocks, any surface, face, or end of the blocks of the present invention may be split, striated, fluted, darted, or be marked with any other possible exterior face texture or design such as designed depressions for accepting windows, doors, and the like or for facilitating the installation of blocks.

There are many applications of the self interlocking block system besides the at-home, Do-It-Yourself applications. Because the blocks interconnect vertically while maintaining the ability to be offset from each other, the present block system has excellent lateral load strength. Therefore, the block system is useful for many industrial applications. For example, the self interlocking block system may be used for above and below grade walls, re-enforced retaining walls, sound barriers on highways, bridge decking, and for replacing tilt-up pre-cast concrete. In addition, the block system can be used to build a wall which is then turned over on its side, thereby providing a deck, platform, or roof.

Because building a conventional wall requires the availability and expense of a skilled mason, the self interlocking block system of the present invention is the "peerless" product of all wall construction products. It is more durable, energy efficient, flexible, fire-proof, seismic resistant, tornado resistant, sound-proof, and safer than any other wall system. This self interlocking block system will be a major paradigm shift in that it will enable millions of square feet of walls to be constructed out of this far superior building product by thousands of more installers who will not be required to be a skilled mason, especially in developing countries (for basic shelter) all over the world.

Another advantage of the self interlocking block system of the present invention is that it produces a finished wall capable of withstanding higher lateral load forces exerted against the exterior of the wall. In most cases, this self interlocking block system eliminates the need for horizontal reinforcing mesh imbedded in the mortar joints between the masonry blocks, as well as, reduce to a great extent the amount of vertical grout and reinforcing steel needed for a given lateral load, thus saving a tremendous amount of time, money and materials. Actually, once a vertical load is placed on this self interlocking block system of the present invention, the need for any horizontal joint reinforcing as well as vertical grout and re-bar reinforcing is virtually eliminated depending on the type of force of the lateral load on the wall.

Another advantage of the self interlocking block system of the present invention is that it provides the ability of a wall to be pre-assembled prior to transporting it to a final destination. That is, due to the simplicity of constructing a basic wall, by stacking blocks on blocks using hollow pegs, a wall can be built at a manufacturing facility. Then, using a bottom plate along the bottom surface of the wall, the wall can be easily lifted and transported with cables and hooks. The cables may drop through vertical shafts of the wall and hook to a bottom plate, or the cables may hook onto the end of a vertical support secured within a vertical shaft of the wall. Once secured to the wall, a crane or other means may pull the cables to lift and move a pre-assembled wall.

In addition, once a basic wall is built without the use of filler material, it can be easily disassembled by simply removing the blocks and hollow pegs from the top of the wall. Once disassembled, the component parts can be used in the construction of another wall.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

FIG. 1A is a planar view of the front face of the block;

FIG. 1B is a perspective view of a block of the present invention;

DETAILED DESCRIPTION OF THE PREFERRED EMBODIMENTS

Figure 2:
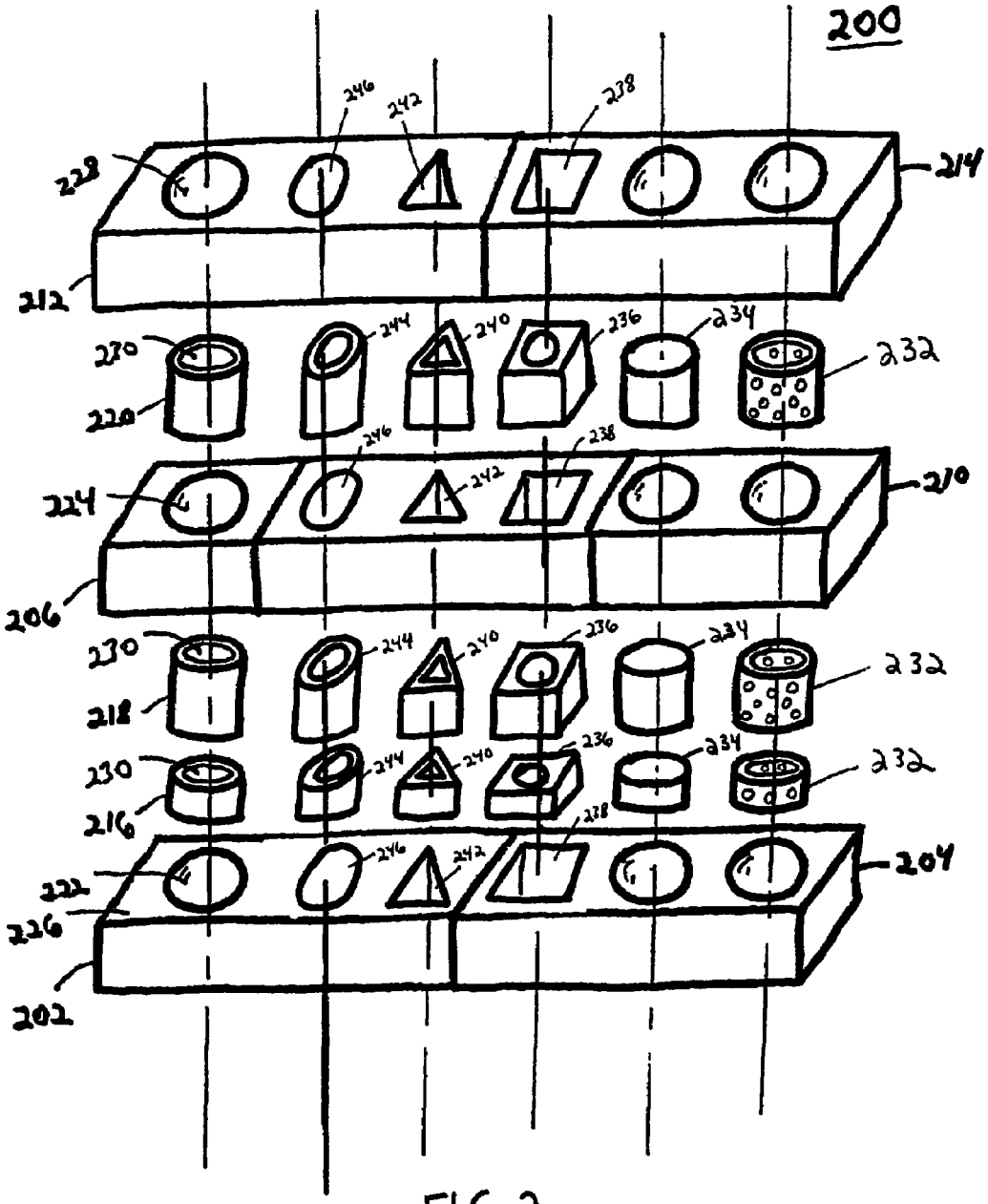
FIG. 2 is a perspective exploded view of a block system of the present invention.

FIGS. 1A and 1B show a block 100 of the present invention, whereas FIGS. 2–7 show the use of a block system 200 of the present invention to build a wall 300. The preferred embodiment of a block 100 of the present invention is a rectangular block 102 having a top surface 104, bottom surface 106, front surface 108, back surface 110, one or more end surfaces (such as first end surface 118 and second end surface 120), and one or more apertures 112*a*–*c* extending through the block 100 from the top surface 104 to the bottom surface 106. The number, round shape, and placement of the apertures 112*a*–*c* in a block 100 are depicted as shown in the figures for convenience purpose only. It would be readily apparent for one of ordinary skill in the relevant art to use a different number, shape, and/or placement of apertures 112*a*–*c* in a block 100 of the present invention depending on the intended application of the block system 200. In addition, blocks 100 of the present invention are made of any appropriate material, including but not limited to, cement, composite material, stone, clay, shale, plastic, and natural biodegradable material. Therefore, blocks 100 are manufactured using either a conventional block machine or by conventional injection molding techniques.

In the preferred embodiment, a block 100 is sized such that the width of the block 100 is equal to about one third of its length. Thus, for example, a block 100 being 24 inches long is 8 inches wide. The block 100 can be any height in order to meet the final wall height requirement, but preferably, all blocks 100 of a wall are the same height. Also, conventional cut outs, holes, darts, or depressions can be placed on any surface of a block 100 as a means for reducing the weight of the block 100 or as a means for facilitating the installation of doors and windows. Furthermore, any surface of a block 100 of the present invention may be split, striated, fluted, darted, or textured for either functional or ornamental reasons.

The block system 200 of the present invention includes a plurality of blocks 100, such as blocks 202, 204, 206, 208, 210, 212, and 214, and a plurality of hollow pegs 216, 218, and 220. The preferred hollow pegs 216, 218, and 220 are cut pieces of conventional PVC tubing having a diameter which is about equal to, or slightly less than, the diameter of an aperture 112 in a block 100, but this is for convenience purpose only. It would be readily apparent to one of ordinary skill in the relevant art to use a comparable hollow peg 208.

In addition, the preferred embodiment of the present invention employs hollow pegs 216, 218, 220 and apertures 222, 224, and 228 that are circular in shape, but this too is for convenience. It would be readily apparent to one of ordinary skill in the relevant art to use a comparable shape, such as square, triangular, oval, etc. Regardless of the shape used, the shape of an aperture 222, 224, and 228 should match the external shape of a hollow peg, 216, 218, 220, thereby allowing the hollow peg 216, 218, and 220 to fit within an aperture 222, 224, and 228 like a puzzle-piece. For example, a square hollow peg 236 is used with a square aperture 238, a triangular hollow peg 240 is used with a triangular aperture 242, and an oval hollow peg 244 is used with an oval aperture 246. However, the internal cavity 230 of a hollow peg 216, 218, and 228 may have the same or a different shape as the aperture 222, 224, and 228. The only requirement being that the hollow cavities 230 of vertically adjacent hollow pegs 216, 218, and 220 align within a vertical shaft 302 of a wall 300. In addition, the use of PVC for the hollow pegs 216, 218, and 220 is for convenience. It would be readily apparent to use hollow pegs 216, 218, and 220 in the present invention made of a different material, including but not limited to, plastic, resin, composite material, fiber material, paper products (e.g., corrugated paper), steel, and aluminum.

To best illustrate the block system 200 of the present invention, the means for interconnecting two blocks 100 only will be described. To interconnect two blocks, a second block 206 is placed on top of a first block 202 such that an aperture 222 of the first block 202 aligns with an aperture 224 of the second block 206, thereby creating a vertical shaft from the first block 202 through to the second block 206. A first hollow peg 216 is inserted into the aperture 222 of the first block 202. In the preferred embodiment the first hollow peg 216 is an end peg such that it has a length about equal to one half of the height of the first block 202. Thus, when placed in the aperture 222, the first hollow peg 216 is within the aperture 222.

After the first hollow peg 216 is in place, a second hollow peg 218 is inserted in the aperture 222 of the first block 202 such that a portion of the second hollow peg 218 extends above the top surface 226 of the first block 202 while a portion of the second hollow peg 218 remains in the aperture 222 of the first block 202. In the preferred embodiment, the second hollow peg 218 is a full peg such that it has a length about equal to the height of the first block 202. When the second hollow peg 218 is in place, the second block 206 is positioned over the second hollow peg 218 such that the aperture 224 of the second block 206 aligns with the aperture 222 of the first block 202 having the second hollow peg 218 positioned therein. The second block 206 is then slide on top of the second hollow peg 218 such that the second hollow peg 1218 extends into the aperture 224 of the second block 206. Because the second hollow peg 218 has a preferred length of the height of the first and second blocks 202, 206, the second hollow peg 218 only extends about half way into the aperture 224 of the second block 206. Thus, the second hollow peg 218 spans vertically between the first block 202 and the second block 206, thereby holding them together.

Also in the preferred embodiment, each aperture 112*a–c* of a block 100 has a means for guiding a hollow peg 216, 218, 220 into an aperture 112*a–c* of the block 100. The preferred means is an aperture 112*a–c* having a guiding portion 114*a–c* and a connecting portion 116*a–c*, wherein the guiding portion 114 of an aperture 112 is a tapered portion of the aperture 112 that tapers from a diameter at the bottom surface 106 of the block 100 to the connecting portion 116 of the aperture 112. In the preferred embodiment, the length of the guiding portion 114 is about one fourth the height of the block 100. The diameter of the aperture 112 at the bottom surface 106 of the block 100 (thus, the diameter of the guiding portion 114) is greater than the diameter of the connecting portion 116 of the aperture 112. This guiding portion 114 of an aperture 112 facilitates and expedites the placement of a block 100 onto a hollow peg 216, 218, 220 wherein it "guides" the hollow peg 216, 218, 220 into the connecting portion 116 of an aperture 112.

In an alternative embodiment, the guiding portion 114 of an aperture 112 is on the top surface 104 of a block 100, wherein the aperture 112 at the bottom surface 106 of the block 100 may or may not have another guiding portion 114. In this embodiment, the placement of a hollow peg 216, 218, and 220 into an aperture 112 is further facilitated by the guiding portion 114 on the top surface 104 of the block 100.

A block 100 of the present invention having a means for guiding, such as a guiding portion 114, can be used in building a wall 300 with any type of vertical connector and is not limited to a vertical connector being a hollow peg 216, 218, and 220. That is, as an alternative to the present invention, a block 100 with a guiding portion 114 can be used with a hollow peg (such as hollow pegs 216, 218, and 220), a solid peg, a pin, and a rod (collectively 234). Thus, a block 100 of the present invention having a guiding portion 114 can be used in conventional interlocking block systems using pins.

Figure 3:
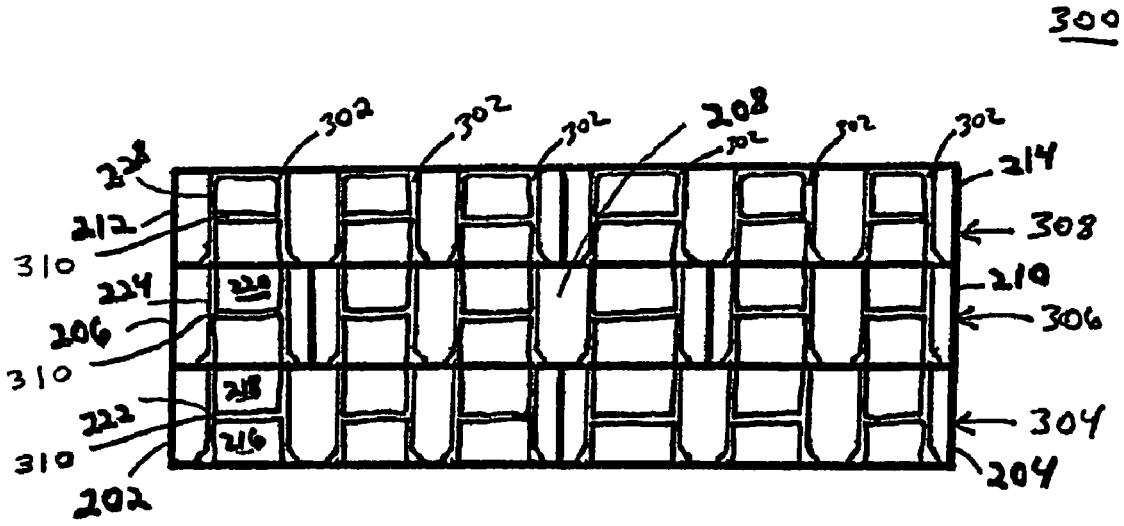
FIG. 3 is a planar, cut-away view of the front face of a wall built with the block system.
Figure 4:
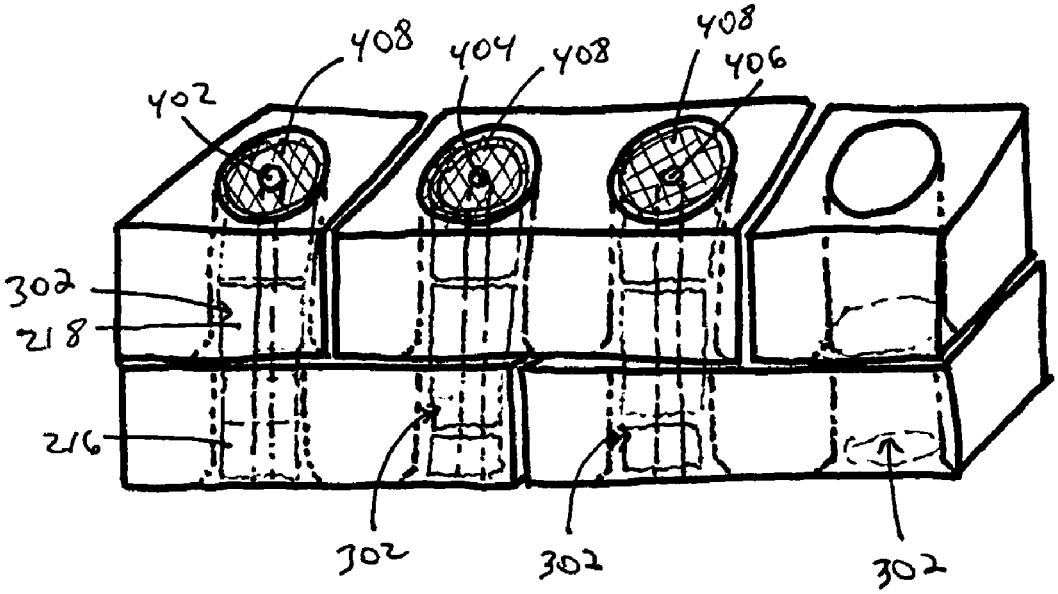
FIG. 4 is a perspective view of the block system with internal supports.

Any number of hollow pegs 216, 218, 220 can be used to connect multiple blocks 100. For example, as shown in FIG. 3, wherein all blocks 100 are the same height and width, a first hollow peg 216 may be used in a first block 202 wherein the length of the first hollow peg 216 is about one half the height of the first block 202. Then, a second block 206 is connected to the first block 202 by a second hollow peg 218. The second hollow peg 218 abuts the top of the first hollow peg 216 and is a length that is about the height of the second block 206. Thus, when in position, a portion of the second hollow peg 218 is in the aperture 222 of the first block 202, and a portion of the second hollow peg 218 is in the aperture 224 of the second block 206.

Then, as shown in this example, a third block 212 is joined to the second block 206 is a similar manner. That is, a third hollow peg 220 is inserted into the aperture 224 of the second block 206 wherein a portion of the third hollow peg 226 remains in the aperture 224 of the second block and a portion of the third hollow peg 220 extends above the top surface 104 of the second block 206. An aperture 228 of the third block 212 is then slide over the third hollow peg 220 thereby joining the second block 206 and the third block 212.

As shown in FIG. 2, the preferred embodiment of the block system 200 of the present invention comprises three types of blocks 100, a primary block, such as block 202 which contains three apertures 222; a first secondary block, such as block 206 which contains one aperture 224; and a second secondary block 210 which contains two apertures. In this system 200, the first secondary block 206 has a length that is one third of the length of the primary block 202, and the second secondary block 210 has a length that is two thirds the length of the primary block 202. This ratio between the lengths of the blocks of the system 200 is important because it allows for a square wall 300 to be built wherein the apertures 112 of vertically adjacent blocks 100 always lineup, even when building a right angle to the wall 300. The use of these lengths is for convenience purpose only.

In addition, the placement of apertures 112 in a primary block 202 facilitates the building of a wall 300. For example, each of the three apertures 222 in a primary block 202 is centered in one third of the block 202, the aperture 224 in the first secondary block 206 is centered in the block 206, and each of the two apertures in a second secondary block 210 is centered in one half of the block 210. Therefore, when using the preferred lengths of blocks 100 as described above, a square wall 300 can be built wherein all of the apertures 222, 224 align no matter which type of block 100 is used: primary block 202, first secondary block 206, or second secondary block 210.

As also described above, the preferred embodiment of the block system 200 uses hollow pegs 216. However, depending on the application of the block system 200, an alternative embodiment of such pegs may be used. For example, hollow pegs 216 having thick walls provides a more stable joint between two blocks 100, or thinner walls to increase the ability of the hollow peg 216 to bend. Also, the hollow pegs 216 may have perforated sides, making them perforated hollow pegs 232, as a means for reducing the weight of the hollow pegs 216.

Also, in the preferred embodiment, a wall 300 is built by placing blocks 100 on top of each other such that the blocks 100 of adjacent rows are offset from each other. As shown in FIG. 3, the blocks 100 of the first row 304 are offset from the blocks 100 of a second row 306, and the blocks 100 of the second row 306 are offset from the blocks 100 of a third row 308. This offset placement of blocks 100 increases the stability and strength of the wall 300. In addition, apertures (such as apertures 222, 224, and 228) of all vertically adjacent blocks (such as blocks 202, 206, and 212) are aligned, thereby creating multiple vertical shafts 302 in the wall 300 extending from the third row 308 to the base surface under the first row 304.

A further means for interconnecting two blocks 100 of the present invention is putting a filler material 408 in the vertical shafts 302 created by the hollow cavities 230 of one or more vertically aligned hollow pegs 216, 218, 220. Filler material 408 can be anything used to stabilize the wall 300 or to enhance the wall features: cement, sand, gravel, foam, insulation, and composite materials. When using a filler material 408, the hollow pegs 216, 218, 220 require close tolerances to ensure no or little leakage of the filler material 408 at the intersection, such as intersections 310, of two adjacent hollow pegs, such as hollow pegs 216, 218, and hollow pegs 218, 220. The tolerance required for adjacent hollow pegs is determined according to the filler material 408 desired. That is, the larger or thicker the filler material 408, the bigger the tolerance may be.

A second further means for interconnecting two blocks 100 of the present invention is putting one or more vertical support bars 402, 404, 406 in the vertical shaft 302 created by the hollow cavity 230 of one or more hollow pegs 216, 218. Preferably, a vertical support bar 402 extends from the base surface, e.g., ground, to the top row, e.g., third row 308, of blocks 100. The vertical support bars 402, 404, 406 optionally may be embedded in or secured to the base surface, e.g., ground, footer or underlying structural support system, under the wall 300. In addition, filler material 408 may be used in combination with vertical support bars 402, 404, 406 to secure the blocks 100 of the wall 300. The preferred vertical support bars 402, 404, 406 are conventional re-bars, or long bars of steel and/or iron, which are traditionally used with a filler material 408 of cement, grout, sand, gravel, insulation, foam, or any composite material.

Figure 5:
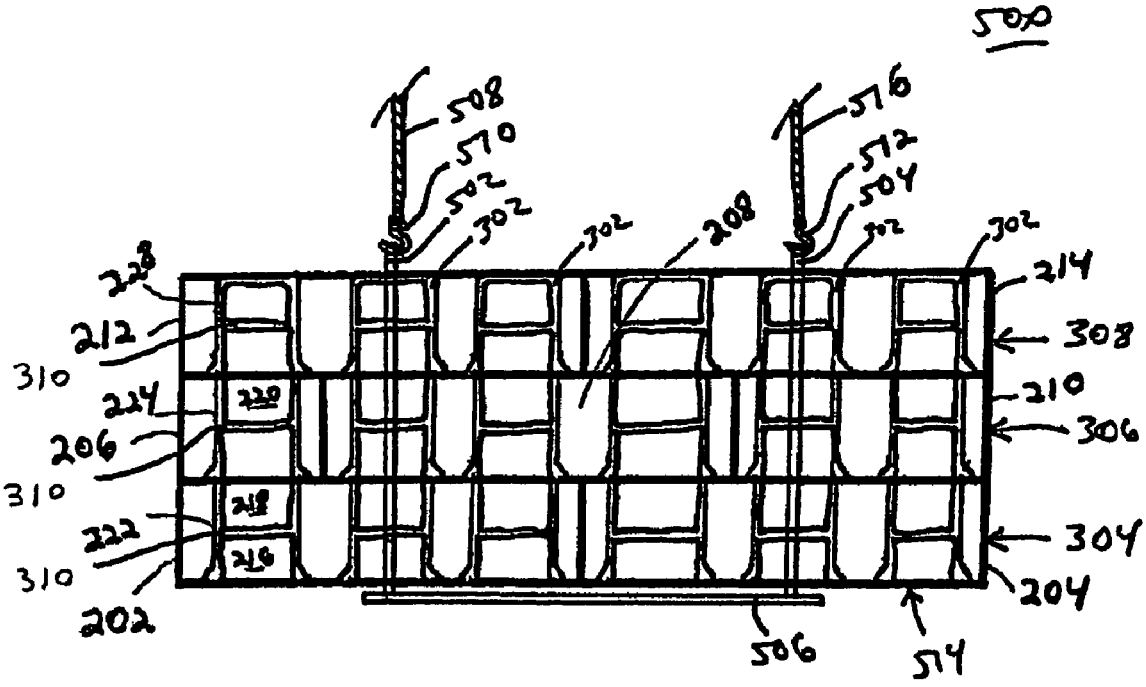
FIG. 5 is a planar, cut-away view of the front face of a wall built with the block system and being transported.

FIG. 5 is a planar, cut-away view of a front face of a wall 500 built with the block system 200 and being transported. In this embodiment, a means for transporting the wall 500 is incorporated into the wall 500. The means for transporting is a bottom plate 506 extending along the bottom surface 514 of the wall 500 wherein two vertical support bars, such as first vertical support bar 502 and second vertical support bar 504, are secured to the bottom plate 506 under the wall 500. The first vertical support bar 502 and second vertical support bar 504 are secured to the bottom plate 506 by conventional methods: fasteners, bolts, and welding. The top end of the first vertical support bar 502 and second vertical support bar 504 are each secured to a hook 510, 512 and cable 508, 516, wherein a crane or other piece of machinery lifts the wall 500 up and transports it via the hooks 510, 512 and cables 508, 516. The bottom plate 506 is used to prevent the hollow pegs 216, 218, and 220, with the optional filler material 408, and vertical support bars 502, 504 from being pulled through the vertical shafts 302 and out of the wall 500. Also, the use of one bottom plate 506 is for convenience. It would be readily apparent to use two or more bottom plates 506 in transporting a wall 500 wherein each bottom plate 506 is has a length sufficient for supporting the wall (such as bottom plate 704 in FIG. 7) and preventing the hollow pegs 216, 218, and 220, with the optional filler material 408, and vertical support bars 502, 504 from being pulled through the vertical shafts 302.

Figure 6:
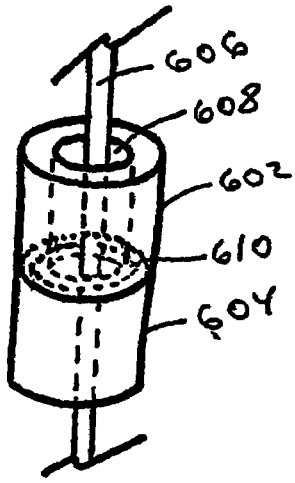
FIG. 6 is a perspective view of an alternative hollow peg assembly.

FIG. 6 is a perspective view of an alternative hollow peg assembly 600 wherein two vertically adjacent hollow pegs 216, 218, 220 in a vertical shaft 302 have the same outside diameter but have different diameters of their respective hollow cavities 230. For example, as shown in FIG. 6, a first hollow peg 602 and a second hollow peg 604 are vertically adjacent and abut each other, wherein said first hollow peg 602 is above said second hollow peg 604 and the first hollow peg 602 and said second hollow peg 604 have the same outside diameter. However, the diameter of the hollow cavity 608 of the first hollow peg 602 is smaller than the diameter of the hollow cavity 610 of the second hollow peg 604.

Employing this hollow peg assembly 600 in a wall further facilitates transport of the wall. When using vertical support bars 606 to lift a wall 500 as described above, the filler material 408 of the second hollow peg 604 will not be pulled through the first hollow peg 602 because the first hollow peg 602 has a narrower hollow cavity 608. Thus, the first hollow peg 602 acts as a stop for the filler material 408 in the second hollow peg 604.

Figure 7:
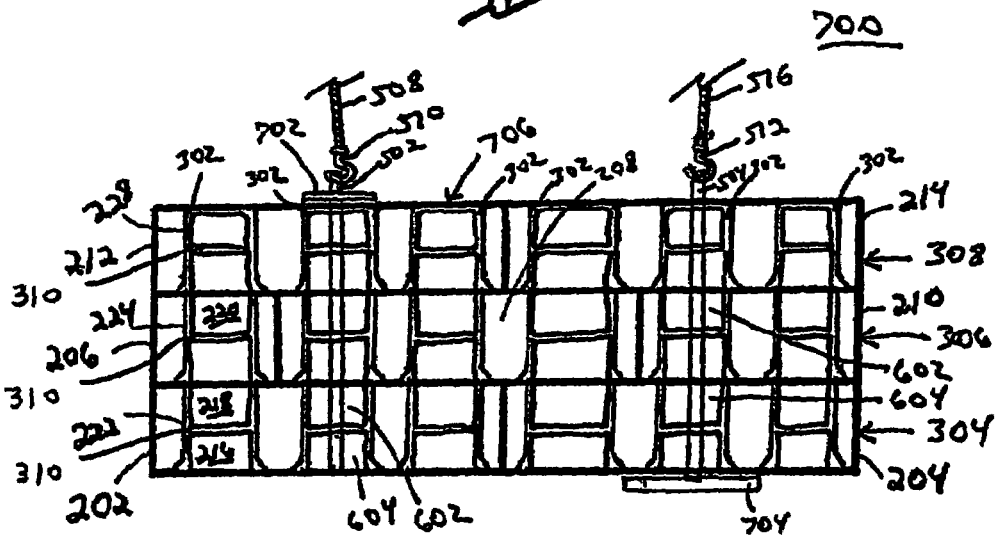
FIG. 7 is a planar, cut-away view of the front face of a wall built with the block system employing an alternative means for transporting.

In addition, as shown in FIG. 7, a top plate 702, or a cap, may be secured to the top surface 706 of a wall 700 by conventional means, thereby preventing the hollow pegs in a vertical shaft from being pulled out during the lifting and transport of the wall 700. As also shown in FIG. 7, the use of the hollow peg assembly 600 of the present invention may be employed at random locations in a wall 700 as needed for strength, durability, lift, and transport of the wall 700.

Furthermore, as shown in the figures, the use of hollow pegs 216, 218, and 220 in all apertures 112 of all blocks 100, thus in every vertical shaft 302 of a wall 300, is for convenience only. When using hollow pegs 216, 218, and 220 in each vertical shaft 302 of a wall 300, the wall 300 is very strong and stable. However, the block system 200 of the present invention works equally as well for other types of applications if hollow pegs 216, 218, and 220 are used only in a select, pre-defined number of vertical shafts 302 of a wall 300. Also, the use of a filler material 408 and/or vertical support bars 402, 404, 406 may be used in a select, pre-defined number of vertical shafts 302 in a wall 300. Depending on the intended use of the wall 300, the resulting wall 300 may be strong enough with only a select number of vertical shafts 302 having filler material 408 and/or vertical support bars 402, 404, and 406. For example, if the block system 200 is used to build a panel for a roof, it may be desirable to reduce the weight of the panel. This can be accomplished by using fewer hollow pegs 216, 218, and 220, filler material 408, and vertical support bars 402, 404 and 406.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined in the specification and the appended claims. Thus, the breadth and scope of the present invention should not be limited by any of the above-described exemplary embodiments, but should be defined in accordance with the specification and any equivalents.

What is claimed is:

1. A block system, comprising:

a plurality of blocks, each block having a top surface, a bottom surface, a front surface, a back surface, one or more end surfaces, a height defined by a distance from said top surface to said bottom surface, and one or more apertures, each aperture being generally grooveless, each aperture extending from said top surface through said block to said bottom surface and having a guiding portion and a connecting portion, said guiding portion having a length of about one fourth said height of said block and having a surface diameter and an ending diameter wherein said surface diameter is a diameter of said aperture at said bottom surface of said block and said ending diameter of said guiding portion is equal to a diameter of said connecting portion, said surface diameter being greater than said ending diameter such that said guiding portion tapers from said surface diameter to said ending diameter, and said connecting portion of each said aperture having a generally uniform diameter equal to said ending diameter of said guiding portion, and wherein said top surface of said block is substantially flat such that when a top surface of a first block is interconnected with a bottom surface of a second block, the guiding portion of said aperture in the bottom surface of the second block remains substantially void of the top surface of said first block;

a plurality of hollow pegs, each said hollow peg having an internal cavity defined by an internal diameter and an outer diameter slightly smaller than said diameter of said apertures in said blocks, and each said hollow peg being generally slitless; and a means for interconnecting a first block with a second block using a first hollow peg and a second hollow peg, wherein said first hollow peg is inserted in one said aperture of said first block such that a portion of said first hollow peg extends above said top surface of said first block and into one said aperture of said second block, thereby creating a vertical shaft through said aperture of said first block and said aperture of said second block, and wherein said second hollow peg is inserted in said one said aperture of said second block such that said second hollow peg is aligned with and abuts said first hollow peg.

2. The block system of claim 1, wherein said means for interconnecting further comprises a filler material in said vertical shaft.

3. The block system of claim 2, wherein said filler material is selected from the group consisting of: cement, sand, gravel, foam, insulation, and a composite material.

4. The block system of claim 1, wherein said means for interconnecting further comprises one or more vertical support bars in said internal cavity of said one or more hollow pegs.

5. The block system of claim 1, wherein said blocks are made of a material selected from the group consisting of cement, composite material, stone, clay, shale, plastic, and natural biodegradable material.

6. The block system of claim 1, wherein said one or more hollow pegs are made of a material selected from the group consisting of plastic, resin, composite material, fiber material, paper products, steel, and aluminum.

7. The block system of claim 1, wherein said first hollow peg has a length about equal to a height of said blocks and said second hollow peg has a length about equal to about one half of said height of said blocks.

8. The block system of claim 1, wherein at least one of said top surface, said bottom surface, said front surface, said back surface, and one or more said end surfaces of said blocks is textured.

9. The block system of claim 1, wherein said internal diameter of said first hollow peg is smaller than said internal diameter of said second hollow peg.

10. A method for building a wall on a base surface, comprising the following steps:

(a) placing a first block on the base surface, said first block comprising a top surface, a bottom surface, a height defined by a distance from said top surface to said bottom surface, a front surface, a back surface, one or more end surfaces, a first aperture, and a second aperture, said first aperture and said second aperture extending from said top surface through said first block to said bottom surface and having a guiding portion and a connecting portion, said guiding portion having a length of about one fourth said height of said block and having a surface diameter and an ending diameter wherein said surface diameter is a diameter of said aperture at said bottom surface of said block and said ending diameter of said guiding portion is equal to a diameter of said connecting portion, said surface diameter being greater than said ending diameter such that said guiding portion tapers from said surface diameter to said ending diameter, and said connecting portion of said first aperture and said second aperture having a generally uniform diameter equal to said ending diameter of said guiding portion;

(b) inserting a first hollow peg in said guiding portion of said first aperture of said first block such that said first hollow peg abuts the base surface, wherein said first hollow peg extends from the base surface to about halfway between said bottom surface of said first block and said top surface of said first block, and wherein said first hollow peg is generally slitless;

(c) inserting a second hollow peg in said guiding portion of said first aperture of said first block such that said second hollow peg abuts said first hollow peg, wherein said second hollow peg has a length about equal to said height of said first block such that after completion of step (c) about half of said second hollow peg protrudes from said first aperture of said first block, and wherein said second hollow peg is generally slitless; and (d) placing a second block on said first block, said second block comprising a top surface, a bottom surface, a height defined by a distance from said top surface to said bottom surface, a front surface, a back surface, one or more end surfaces, a first aperture, and a second aperture, said first aperture and said second aperture extending from said top surface through said second block to said bottom surface and having a guiding portion and a connecting portion, said guiding portion having a length of about one fourth said height of said second block and having a surface diameter and an ending diameter wherein said surface diameter is a diameter of said aperture at said bottom surface of said second block and said ending diameter of said guiding portion is equal to a diameter of said connecting portion, said surface diameter being greater than said ending diameter such that said guiding portion tapers from said surface diameter to said ending diameter, and said connecting portion of said first aperture and said second aperture having a generally uniform diameter equal to said ending diameter of said guiding portion, wherein said second block is positioned on said first block such that said first aperture of said first block aligns with said second aperture of said second block, thereby creating a first vertical shaft wherein about half of said second hollow peg is inserted into said guiding portion of said second aperture of said second block, and further wherein said top surface of said first block is substantially flat such that when the top surface of said first block is interconnected with the bottom surface of said second block, the guiding portion of said aperture in the bottom surface of the second block remains substantially void of the top surface of said first block.

11. The method of claim 10, further comprising the step of:

(e) filling said first vertical shaft with a filler material.

12. The method of claim 11, wherein said filler material is selected from a group consisting of: cement, sand, gravel, foam, insulation, and composite material.

13. The method of claim 10, further comprising the step of:

(e) inserting a vertical support bar in said first vertical shaft, said vertical support bar extending through said first block and said second block.

14. The method of claim 13, further comprising the step of:

(f) filling said first vertical shaft with a filler material after said step (e).

15. The method of claim 10, wherein said first block and said second block are made of a material selected from the group consisting of cement, composite material, stone, clay, shale, plastic, and natural biodegradable material.

16. The method of claim 10, wherein said first hollow peg and said second hollow peg are made of a material selected from the group consisting of plastic, resin, composite material, fiber material, paper products, steel, and aluminum.

17. The method of claim 10, further comprising the steps of:

(e) inserting a third hollow peg in said second aperture of said second block such that said third hollow peg abuts said second hollow peg, wherein said third hollow peg has a length about equal to said height of said second block such that after completion of step (e) about half of said third hollow peg protrudes from said second aperture of said second block, and wherein said third hollow peg is generally slitless; and (f) placing a third block on said second block, said third block comprising a top surface, a bottom surface, a height defined by a distance from said top surface to said bottom surface, a front surface, a back surface, one or more end surfaces, a first aperture, and a second aperture, said first aperture and said second aperture extending from said top surface through said third block to said bottom surface and having a guiding portion and a connecting portion, said guiding portion having a length of about one fourth said height of said second block and having a surface diameter and an ending diameter wherein said surface diameter is a diameter of said aperture at said bottom surface of said second block and said ending diameter of said guiding portion is equal to a diameter of said connecting portion, said surface diameter being greater than said ending diameter such that said guiding portion tapers from said surface diameter to said ending diameter, and said connecting portion of said first aperture and said second aperture having a generally uniform diameter equal to said ending diameter of said guiding portion, wherein said third block is positioned on said second block such that said first aperture of said third block aligns with said second aperture of said second block, thereby extending said first vertical shaft wherein about half of said third hollow peg is inserted into said guiding portion of said first aperture of said third block.

18. A block system, comprising:

a block having a top surface, a bottom surface, a height defined by a distance from said top surface to said bottom surface, a front surface, a back surface, one or more end surfaces, and one or more apertures, each aperture being generally grooveless, each aperture extending from said top surface through said block to said bottom surface and having a guiding portion and a connecting portion, said guiding portion having a length of about one fourth said height of said block and having a surface diameter and an ending diameter wherein said surface diameter is a diameter of said aperture at said bottom surface of said block and said ending diameter of said guiding portion is equal to a diameter of said connecting portion, said surface diameter being greater than said ending diameter such that said guiding portion tapers from said surface diameter to said ending diameter, and said connecting portion of said aperture has a generally uniform diameter equal to said ending diameter of said guiding portion, and wherein said top surface of said block is substantially flat such that when a top surface of a first block is interconnected with a bottom surface of a second block, the guiding portion of said aperture in the bottom surface of the second block remains substantially void of the top surface of said first block; and one or more hollow pegs, each said hollow peg having an internal cavity defined by an internal diameter and an outer diameter slightly smaller than said diameter of said apertures in said blocks, and each said hollow peg being generally slitless, wherein one said hollow peg is inserted in one said aperture of said block.

19. The block system of claim 18, wherein said block is made of a material selected from the group consisting of cement, composite material, stone, clay, shale, plastic, and natural biodegradable material.

20. The block system of claim 18, wherein said one or more hollow pegs are selected from the group consisting of a hollow peg, a perforated hollow peg, a solid peg, a pin, and a rod.

21. The block system of claim 18, wherein said one or more hollow pegs are made of a material selected from the group consisting of plastic, resin, composite material, fiber material, paper products, steel, and aluminum.

22. The block system of claim 18, wherein each of said one or more hollow pegs have a length selected from the group consisting of: about a height of said block, and about one half a height of said block.

* * * * *